US010047521B2

(12) United States Patent
Hernandez, Sr.

(10) Patent No.: US 10,047,521 B2
(45) Date of Patent: Aug. 14, 2018

(54) SUSPENDED WALL TRACK SYSTEM

(71) Applicant: Arthur S. Hernandez, Sr., Grand Prairie, TX (US)

(72) Inventor: Arthur S. Hernandez, Sr., Grand Prairie, TX (US)

( * ) Notice: Subject to any disclaimer, the term of this patent is extended or adjusted under 35 U.S.C. 154(b) by 0 days.

(21) Appl. No.: 15/018,720

(22) Filed: Feb. 8, 2016

(65) Prior Publication Data

US 2017/0226735 A1 Aug. 10, 2017

(51) Int. Cl.

| | |
|---|---|
| ***E04B 2/82*** | (2006.01) |
| ***E04B 2/74*** | (2006.01) |
| ***E04B 9/00*** | (2006.01) |
| *E04B 9/18* | (2006.01) |
| *E04B 9/24* | (2006.01) |

(52) U.S. Cl.

CPC ..... *E04B 2/82* (2013.01); *E04B 2/7448* (2013.01); *E04B 9/008* (2013.01); *E04B 9/18* (2013.01); *E04B 9/241* (2013.01)

(58) Field of Classification Search

CPC ..... E04B 2/82; E04B 2/7448; E04B 1/343; E04B 1/34357; E04B 2/827; E04B 2/7401; E04H 6/04

USPC ..... 52/64, 66, 68, 173.1, 506.06; 454/296; 181/284

See application file for complete search history.

(56) References Cited

U.S. PATENT DOCUMENTS 3,141,207 A * 7/1964 Kahler ..... E04B 2/827 49/125
3,175,656 A * 3/1965 Schoenfeld ..... E04B 9/064 52/506.06
3,319,558 A * 5/1967 Bodian ..... E04B 9/02 454/296
3,333,524 A * 8/1967 Mariner ..... E04B 9/001 181/284
3,619,960 A * 11/1971 Thompson ..... E04B 9/008 52/241
4,512,118 A * 4/1985 Rasmussen ..... 52/39
4,535,578 A * 8/1985 Gerken ..... E04B 2/827 49/317
5,146,723 A * 9/1992 Greenwood et al. ..... 52/288.1
5,675,946 A * 10/1997 Verbeek ..... E04B 2/7416 52/205

(Continued)

FOREIGN PATENT DOCUMENTS

| | | | |
|---|---|---|---|
| CA | 2697295 A1 * | 2/2009 | ..... E04B 1/948 |
| DE | 2435301 | 1/1985 | |
| GB | 945971 | 1/1964 | |

OTHER PUBLICATIONS

ISR/Written Opinion for PCTUS2017016559 dated Apr. 19 2017, 12 pages.

*Primary Examiner* — Joshua J Michener
*Assistant Examiner* — Keith Minter
(74) *Attorney, Agent, or Firm* — Law Office of Jeff Williams; J. Oliver Williams

(57) ABSTRACT

A interior partition includes a suspended wall track system that includes suspended wall track frame that aligns and receives an interior wall material to create a non-load bearing wall structure. The suspended wall track system may further include a suspended wall track frame that is fitted within a suspended ceiling track hanging from a ceiling floor with an unobstructed interstitial spacing between the suspended ceiling track and the ceiling floor.

8 Claims, 4 Drawing Sheets

(56) References Cited

U.S. PATENT DOCUMENTS

| | | | | |
|---|---|---|---|---|
| 6,374,456 | B1 * | 4/2002 | Fort | E05D 15/0613 16/87.6 R |
| 6,634,149 | B2 * | 10/2003 | Cates | E04B 2/7453 52/238.1 |
| 8,061,103 | B2 * | 11/2011 | McMahon | E04B 1/0046 52/281 |
| 8,584,317 | B2 * | 11/2013 | Liebscher | E04B 2/827 16/91 |
| 2003/0163962 | A1 * | 9/2003 | Jefferson | H02G 3/30 52/220.1 |
| 2007/0125026 | A1 * | 6/2007 | Frobosilo | E04B 2/7457 52/481.1 |
| 2009/0038764 | A1 * | 2/2009 | Pilz | E04B 2/82 160/194 |
| 2010/0095615 | A1 * | 4/2010 | Houle | E04B 2/7448 52/264 |
| 2011/0131900 | A1 * | 6/2011 | Grandi | E04B 9/006 52/173.1 |
| 2017/0051505 | A1 * | 2/2017 | Newcomer | E04B 2/7401 |

* cited by examiner

SUSPENDED WALL TRACK SYSTEM

TECHNICAL FIELD

The disclosed technology relates generally to non-structural interior walls, ceilings, and soffits. More specifically, embodiments of the present disclosure are directed towards the construction of a suspended wall track system for installing non-structural partitions, ceilings, and soffits.

BACKGROUND

Many large buildings, such as hospitals, offices, department stores, and high-rise buildings, are constructed to include interior walls, ceiling, and soffits that are non-structural. Such non-structural interior walls, ceiling, and soffits allow larger existing floor plans to be easily divided up into smaller areas to create smaller private spaces, such as individual office spaces or rooms.

Additionally, suspended or drop-down ceilings are often the most common type of ceilings utilized in such large buildings, which consequently creates a concealed or interstitial space between the drop-down ceiling and the next floor or structural ceiling above. This interstitial spacing may be a designated area to allow the proper mechanical, plumbing, sprinkler, and electrical connections to be made in order to maintain a proper and functional floor space. However, many of the current non-structural interior walls frequently extend past the suspended or drop-down ceilings and even make structural contact with the next floor level or ceiling level. Because the presence of the interior walls within the interstitial spacing serves no structural purpose, such use of excess interior wall material is a waste in excess labor fees and construction materials. Additionally, the interior walls within the interstitial spacing take up unnecessary space, and potentially block the running of mechanical ductwork, conduit, or other infrastructure materials.

BRIEF SUMMARY OF EMBODIMENTS

Embodiments of the disclosed technology are directed toward a suspended wall track system. In particular embodiments, the suspended wall track system receives an interior wall material to create an interior partition. Additionally, now that the interior wall material, or otherwise known as an interior partition, is fastened to the suspended wall track system, an unobstructed interstitial spacing between the suspended ceiling track and the ceiling floor is created.

In further embodiments, a method for implementing a suspended wall track system is provided. The method may include installing a suspended ceiling track with a series of guide tracks to assist in aligning and supporting a suspended ceiling panel beneath the ceiling floor. Additionally, the method may also include aligning a suspended wall track frame within the suspended ceiling track and installing interior wall material within the suspended wall track frame with unobstructed interstitial spacing available between the suspended ceiling track and the ceiling floor.

BRIEF DESCRIPTION OF THE DRAWINGS

The technology disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

The figures are not intended to be exhaustive or to limit the disclosed technology to the precise form disclosed. It should be understood that the disclosed technology can be practiced with modification and alteration, and that the disclosed technology be limited only by the claims and the equivalents thereof.

DETAILED DESCRIPTION OF THE EMBODIMENTS

The following description is non-limiting and is made merely for the purpose of describing the general principles of the disclosed embodiments. Numerous specific details are set forth to provide a full understanding of various aspects of the subject disclosure. It will be apparent, however, to one ordinarily skilled in the art that various aspects of the subject disclosure may be practiced without some of these specific details. In other instances, well-known structures and techniques have not been shown in detail to avoid unnecessarily obscuring the subject disclosure.

Figure 1:
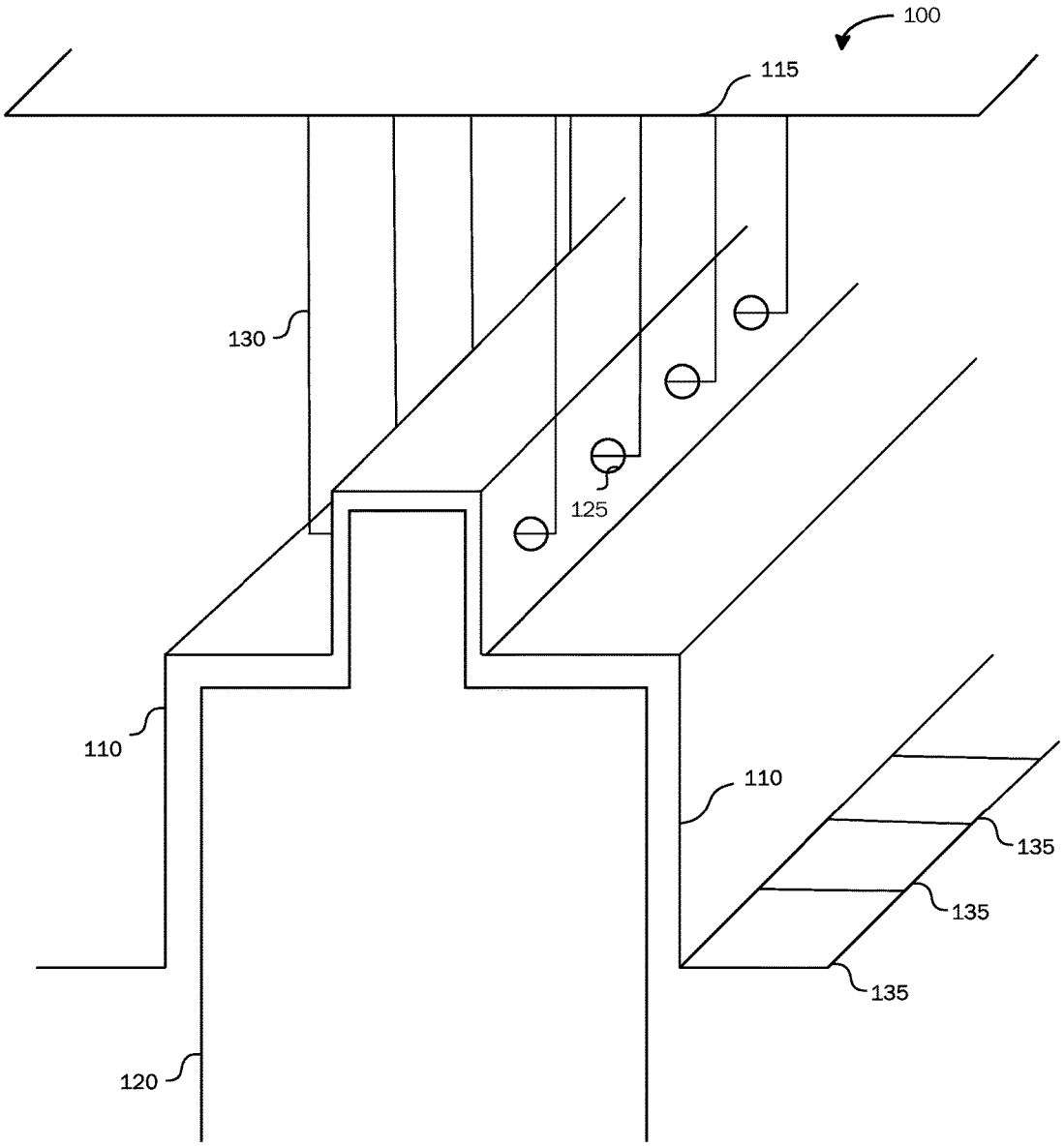
FIG. 1 illustrates a cross view of a suspended wall track system, consistent with embodiments disclosed herein.

FIG. 1 illustrates a cross view of a suspended wall track system 100 for attaching onto a main structural ceiling 115, consistent with embodiments disclosed herein. As illustrated, a suspended ceiling track 110 is suspended or hung below a main structural ceiling 115 by wires 130. More specifically, the suspended ceiling track 110 may include a grid work of metal channels where the grid may be configured to align and support a ceiling panel 135. Once each ceiling panel is placed within each grid configuration, a suspended ceiling may be created. Because the suspended ceiling tracks allow the ceiling panels to be suspended in the air, there is interstitial spacing between the suspended ceiling track 110 and the main structural ceiling 115.

Additionally, the suspended ceiling track 110 may include metal channels that outlines the frame or a perimeter of a non-structural interior wall or interior partition to be raised and created on the existing floor plan. In some embodiments, the suspended ceiling track 110 may include various metal channels that outline the same general shape of the suspended wall track frame 120. Because interior wall material may be installed within the suspended wall track frame 120 to create the interior partition, the suspended wall track frame 120 may include various shapes and sizes in order to accommodate the various shapes and sizes of the interior partition to be created. By way of example only, the interior walls to be installed within the suspended wall track frame 120 may include material such as plywood, plasterboard, timber, ceramic tiles, stone, glass, drywall, etc. Other materials may be used as would be appreciated by one of ordinary skill in the art upon studying the present disclosure. Therefore, in some embodiments, the suspended ceiling track 110 is configured to receive a suspended wall track frame 120, such that both the suspended ceiling track 110 and the suspended wall track frame 120 is hanging or suspended from the main structural ceiling 115.

In order to ensure that the suspended ceiling track 110 and the suspended wall track frame 120 is securely suspended from the main structural ceiling 115, the suspended ceiling track 110 may include holes 125 for a wire already attached to the main structural ceiling 115 to pass through the holes 125. Additionally, the suspended wall track frame 120 may also include corresponding holes, thus further allowing the holes on the suspended wall track frame 120 and the holes 125 in the suspended ceiling track 110 to be properly aligned. When the suspended wall track frame 120 is fitted within the suspended ceiling track 110 such that the holes 125 from the suspended ceiling track 110 are properly aligned with the corresponding holes of the suspended wall track frame 120, a wire from the main structural ceiling 115 may then pass through the holes 125 so that both the suspended wall track frame 120 and the suspended ceiling track 110 is securely hanging from the main structural ceiling 115. As such, this allows contractors who are in charge of creating suspended ceilings to also be in charge of installing a suspended wall track frame 120, thus further saving time and labor when implementing an interior partition on a floor space.

Furthermore, because the suspended wall track frame 120 is fitted within the suspended ceiling track 110, the interior wall material installed within the suspended wall track frame 120 never reaches or makes contact with the main structural ceiling 115. As such, there is unobstructed interstitial spacing between the interior partition and the main structural ceiling 115. Thus, the unobstructed space allows the area to have more open space to be filled with mechanical, electrical, plumbing, and sprinkler connections necessary for an operational and fully functional floor space below. In some embodiments, the interstitial spacing between the suspended ceiling track 110 and the main structural ceiling 115 ranges from 1 to 12 feet. Additionally, the interstitial spacing between the suspended wall track frame 120 and the main structural ceiling 115 may also range from 1 to 12 feet.

Furthermore, because the suspended wall track 120 never reaches the main structural ceiling 115, there is a greatly reduced need for mechanical fire rated plenums and fire caulking due to the reduced interior wall penetrations into the interstitial space areas. Additionally, there is an enhanced ability to create a fire rated exit corridor without the framing, hanging of drywall, and fire tapings of the interior walls to the next floor level. As such, the implementation of a suspended wall track system 100 for an interior partition to attach to, has greatly reduced the need for additional material costs while further enhancing security and fire safety within the building.

Figure 2:
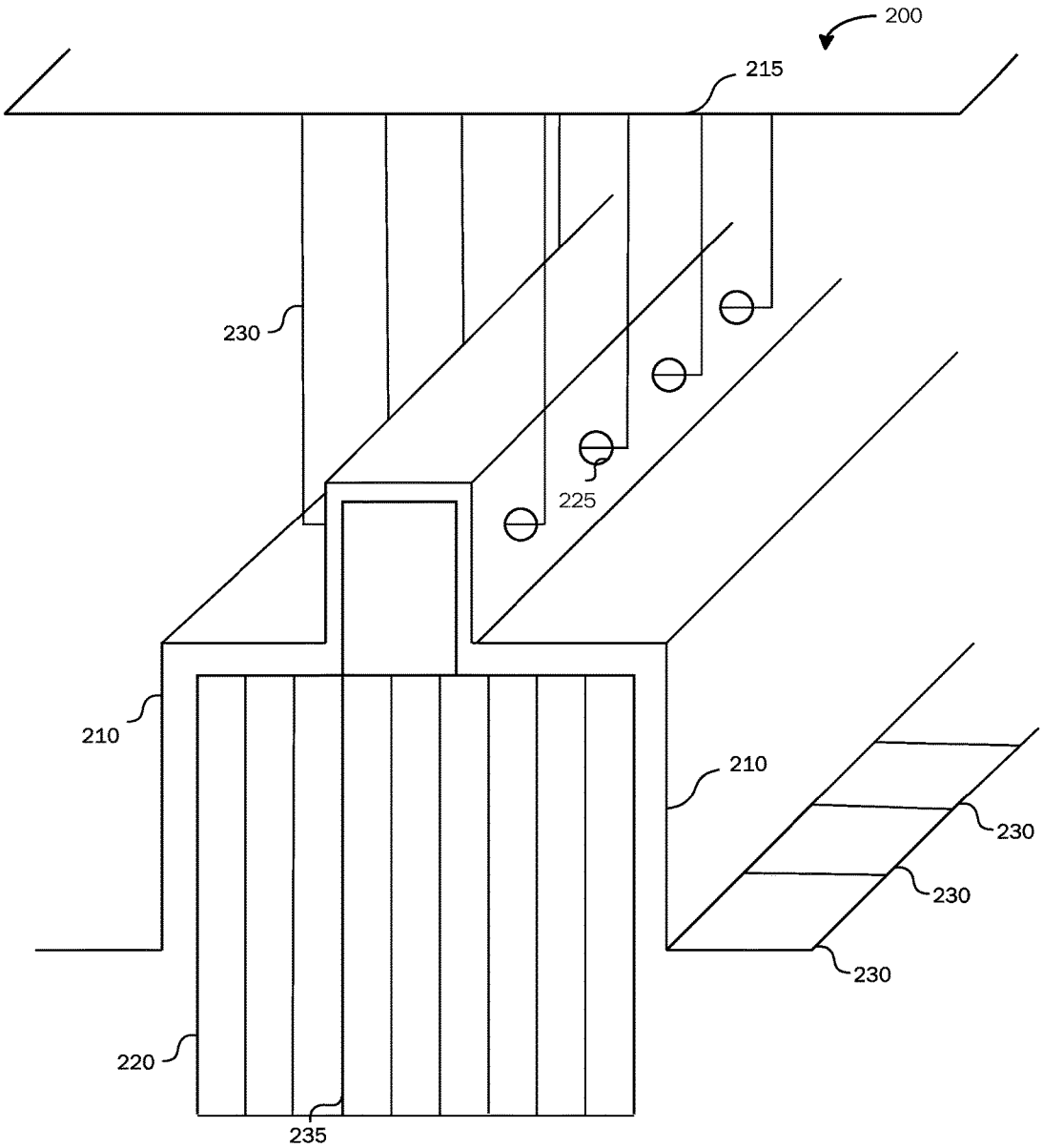
FIG. 2 illustrates a cross view of a suspended wall track system, consistent with embodiments disclosed herein.

FIG. 2 illustrates a cross view of a suspended wall track system 200 for attaching onto the main structural ceiling 215, consistent with embodiments disclosed herein. Similar to FIG. 1, the suspended ceiling track 210 receives or encloses the suspended wall track frame 220. Additionally, the suspended ceiling track 210 and the suspended wall track frame 220 may be suspended from the main structural ceiling 215 via a wire 230 already attached to the main structural ceiling 215. The wire 230 may pass through the aligned holes 225 of the suspended ceiling track 210 and the corresponding holes of the suspended wall track frame 220 in order to securely hang both the suspended ceiling track 210 and the suspended wall track frame 200 from the main structural ceiling 215.

In some embodiments, the suspended wall track frame 220 includes a stud partition 235 to provide a framing support for the interior wall material to be placed within the suspended wall track frame 220. By way of example only, the stud partition 235 may include a metal partition or a wooden partition, such that the interior wall material is then installed within the framed partitions.

Figure 3:
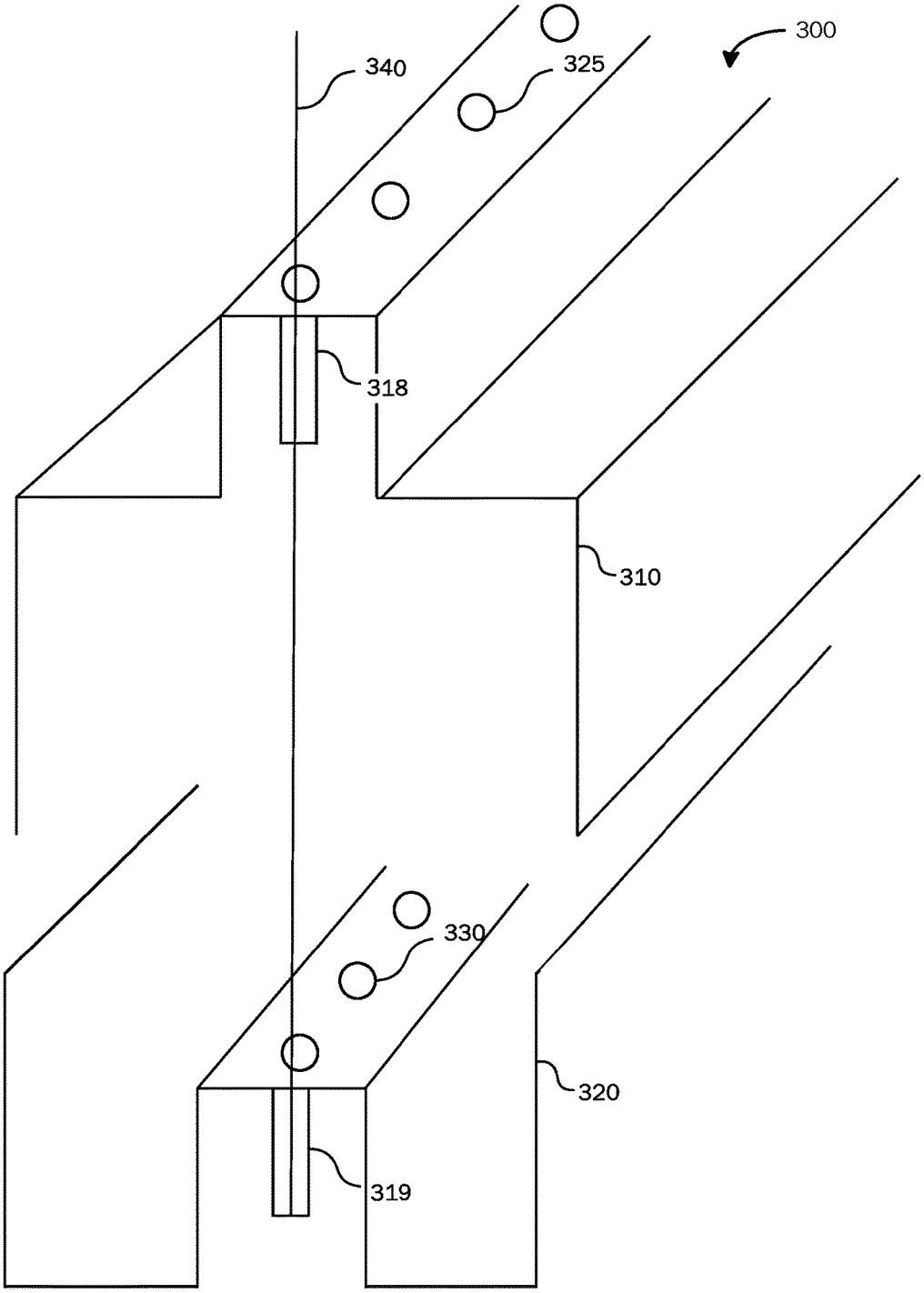
FIG. 3 illustrates a cross view of a suspended wall track system, consistent with embodiments disclosed herein.

FIG. 3 illustrates a cross view of another example of a suspended wall track system 300 for attaching onto the main structural ceiling (not shown here), consistent with embodiments disclosed herein. In this particular embodiment, the suspended wall track system 300 includes a first suspended wall track frame 310 and a second wall track frame 320 that are both suspended from the main structural ceiling (not shown here) via wires 340. Additionally, as illustrated, the suspended wall tracks frames 310 and 320 will include corresponding holes 325, 330 that align with the top surface of the first suspended wall track 310 and the top surface of the second suspended wall track 320. The fastening of the wires 340 attached to the main structural ceiling (not shown here) with the corresponding holes 325, 330 may allow both the first suspended wall track 310 and the second suspended wall track 320 to remain securely suspended or hanging from the main structural ceiling (not shown here). By way of example, the wires 340 may securely suspend the first suspended wall track frame 310 and the second wall track frame 320 from the main structural ceiling (not shown here) via fasteners 318, 319.

In some embodiments, an empty space may be present between the first suspended wall track frame 310 and the second suspended wall track frame 320. By way of example only, the empty space between the suspended wall track frames 310, 320 may range from one inch to 20 feet. Additionally, as illustrated, when the first suspended wall track frame 310 and the second suspended wall track frame 320 are suspended in unison, a soffit may be constructed. Soffits are not only accents that may be utilized for purely cosmetic purposes to the ceilings, but may also be ideal when placing light fixtures or other infrastructure fixtures within the open space areas in the soffit. For example, soffits may be ideal in concealing lights that reflect off of the ceiling or the floor in order to create a glowing or optical illuminating affect within a room or floor space. In other instances, the soffit may be utilized to place sprinklers, smoke alarms, vents, mechanical ductwork, conduit, or other infrastructure materials.

Figure 4:
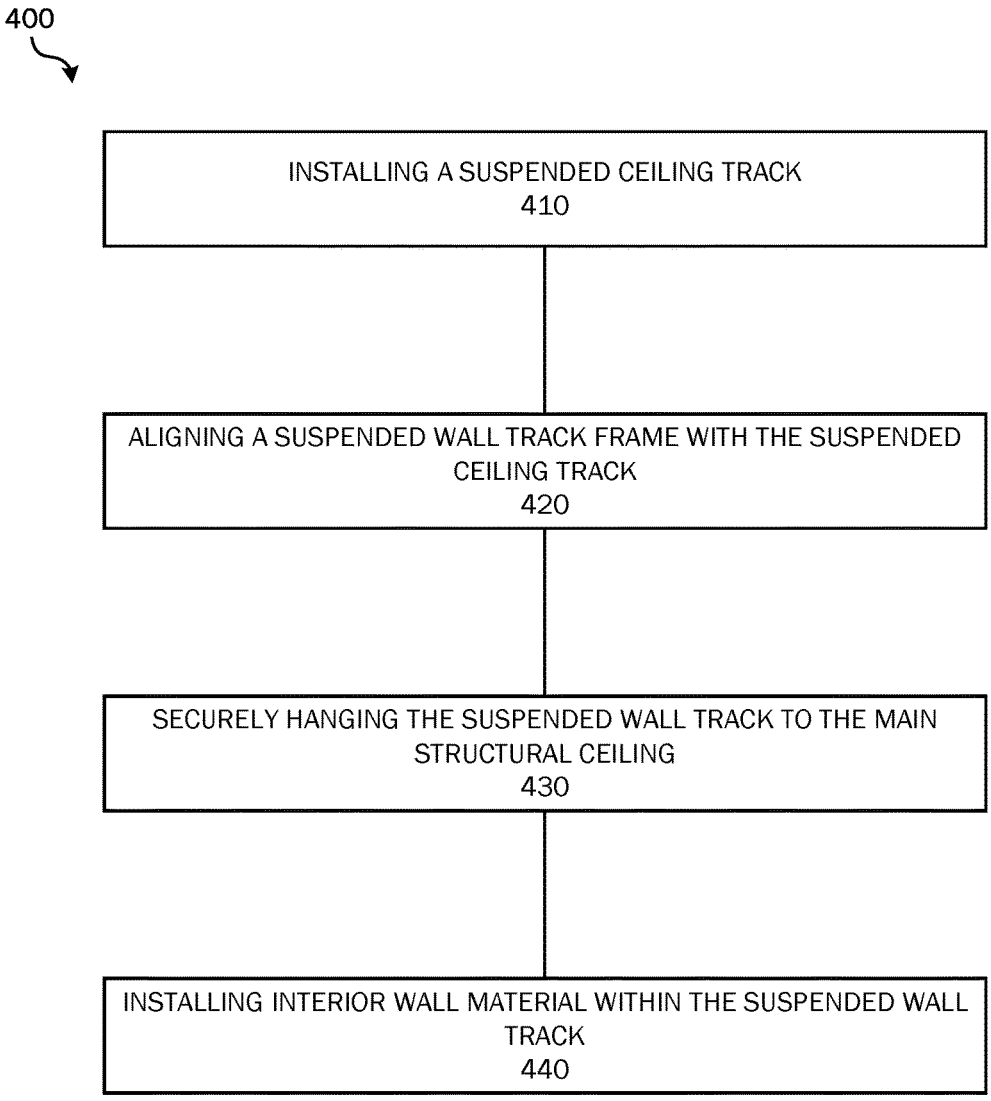
FIG. 4 is a flow chart illustrating an exemplary process for implementing a suspended wall track system, consistent with embodiments disclosed herein.

FIG. 4 is a flow chart illustrating an exemplary process for implementing a suspended wall track system and a suspended ceiling track system. The exemplary process 400 begins at operation 410 by installing a suspended ceiling track with a series of guide tracks to assist in aligning and supporting a suspended ceiling panel beneath a ceiling floor or main structural ceiling. By way of example only, the guide tracks may include a grid work of metal channels that are suspended on wires attached to the main structural ceiling. Once each ceiling panel is placed within each grid configuration of the guide tracks configured to support and receive a ceiling panel, a complete suspended ceiling is created. Because the suspended ceiling track allows the ceiling panels to be suspended in the air, there is interstitial spacing between the suspended ceiling track and the main structural ceiling.

The exemplary process 400 may then proceed to operation 420 where the suspended track wall is aligned and placed within the suspended ceiling track. More specifically, the suspended ceiling track may further be configured to outline the perimeter of the interior wall to be installed within the suspended ceiling track. As a result, a suspended wall track frame may further be configured to be placed within the suspended ceiling track, such that the interior wall material is placed within the suspended wall track frame that provides structure and support to the interior walls.

In some instances, the suspended wall track frame may be attached to the suspended ceiling track for upright support and foundational stability. In further embodiments, the suspended wall track frame may include an internal stud partition to provide framing support for the interior wall material. By way of example only, the stud partition may include a metal stud or wooden stud. Regardless, the suspended wall track may be incorporated within the suspended ceiling track.

The exemplary process 400 may then further proceed to operation 430, where the suspended ceiling track and the suspended wall track frame are securely suspended or hanging from the main structural ceiling. The suspended ceiling track and the suspended wall track frame are securely suspended from the main structural ceiling via wires attached to the main structural ceiling. More specifically, the suspended ceiling track and the suspended wall track frame may both have corresponding holes so that when the holes are aligned, the suspended wall track frame is perfectly aligned and fitted within the suspended ceiling track. The wires that are pre fastened to the structural ceiling may then be inserted through the corresponding holes, thus allowing the interior partition to be securely fastened to the suspended wall and ceiling track system.

The exemplary process 400 may then proceed to operation 440 where the interior wall material is fastened to the metal stud or wood stud partition that is fastened to the suspended wall track frame. By way of example, the interior walls may include plywood, plasterboard, timber, ceramic tiles, stone, glass, drywall, etc. Other materials may be used as would be appreciated by one of ordinary skill in the art upon studying the present disclosure.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that can be included in the disclosed technology. The disclosed technology is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the technology disclosed herein. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A suspended wall track system comprising:

a wall track frame configured to overlap an interior wall stud, the wall track frame having:

a pair of horizontal members extending outward from each other;

a wall track upper protrusion member in communication with the pair of horizontal members, the wall track upper protrusion member having a plurality of holes; and a pair of lower extending sides perpendicular to the pair of horizontal members, the pair of lower extending sides extending downward from the pair of horizontal members along an outer most distal edge of each of the pair of horizontal members, the upper protrusion member extending away from the pair of horizontal members opposite that of the pair of lower extending sides; and a suspended ceiling track configured to cover the pair of horizontal members and the pair of lower extending sides of the wall track frame, the suspended ceiling track including:

an upper surface;

a ceiling track protrusion member in communication with the upper surface and configured to overlap the wall track upper protrusion member, the ceiling track protrusion member having a plurality of holes;

a pair of opposing side surfaces extending downward from the upper surface, the opposing side surfaces extending outside of the pair of lower extending sides of the wall track frame such that the suspended ceiling track overlaps a portion of the pair of lower extending sides of the wall track frame; and a flange extending outward from the pair of opposing sides and configured to hold a ceiling panel, the flange located below the upper surface, the flange being located below the pair of horizontal members of the wall track frame;

wherein the wall track frame and the suspended ceiling track are configured to suspend from a structural ceiling; and wherein the wall track frame aligns with and receives an interior wall material and is adjustably fitted within the suspended ceiling track.

2. The suspended wall track system of claim 1, wherein the wall track frame further comprises a stud partition to provide a framing support for the interior wall material.

3. The suspended wall track system of claim 2, wherein the stud partition comprises a metal stud or a wooden stud.

4. The suspended wall track system of claim 1, wherein the plurality of holes of the wall track protrusion member and the plurality of holes of the ceiling track protrusion member are located on at least one of a top surface or a side surface.

5. The suspended wall track system of claim 4, wherein the plurality of holes on the wall track protrusion member and the plurality of holes on the ceiling track protrusion member are aligned with one another.

6. The suspended wall track system of claim 5, further including a wire configured to pass through the plurality of holes of the wall track upper protrusion member and the plurality of holes of the ceiling track upper protrusion member so as to suspend the suspended ceiling track and the wall track frame from the ceiling floor, the wire fastened to the structural ceiling.

7. The suspended wall track system of claim 1, wherein interstitial spacing between the structural ceiling and the suspended ceiling track ranges from 1-12 feet.

8. The suspended wall track system claim 7, wherein the interstitial spacing provides greater space to implement at least one of a mechanical, electrical, plumbing, and sprinkler connections.

* * * * *